United States Patent [19]

Helvy et al.

[11] Patent Number: 4,855,642

[45] Date of Patent: Aug. 8, 1989

[54] FOCUSING ELECTRODE STRUCTURE FOR PHOTOMULTIPLIER TUBES

[75] Inventors: Fred A. Helvy, Lancaster; Gilbert N. Butterwick, Leola, both of Pa.

[73] Assignee: Burle Technologies, Inc., Lancaster, Pa.

[21] Appl. No.: 170,016

[22] Filed: Mar. 18, 1988

[51] Int. Cl.[4] ..... H01J 43/06

[52] U.S. Cl. ..... 313/532

[58] Field of Search ..... 313/533, 528, 382, 383, 313/379, 526, 529, 532, 540, 534, 536, 460

[56] References Cited

U.S. PATENT DOCUMENTS 4,306,171 12/1981 Faulkner et al. ..... 313/533

4,311,939 1/1982 Faulkner et al. ..... 313/533

*Primary Examiner*—Donald J. Yusko

*Assistant Examiner*—Michael Horabik

*Attorney, Agent, or Firm*—Martin Fruitman

[57] ABSTRACT

A focusing electrode structure for a photomultiplier tube which optimizes the tube operation. One or more focusing electrodes located between the photocathode and the first dynode are configured in the shape of substantial sections of a spheroid dome with the smaller opening nearer to the photocathode. In the preferred embodiment three focusing electrodes are used with their sizes increasing and their voltages decreasing as they approach the photocathode.

8 Claims, 1 Drawing Sheet

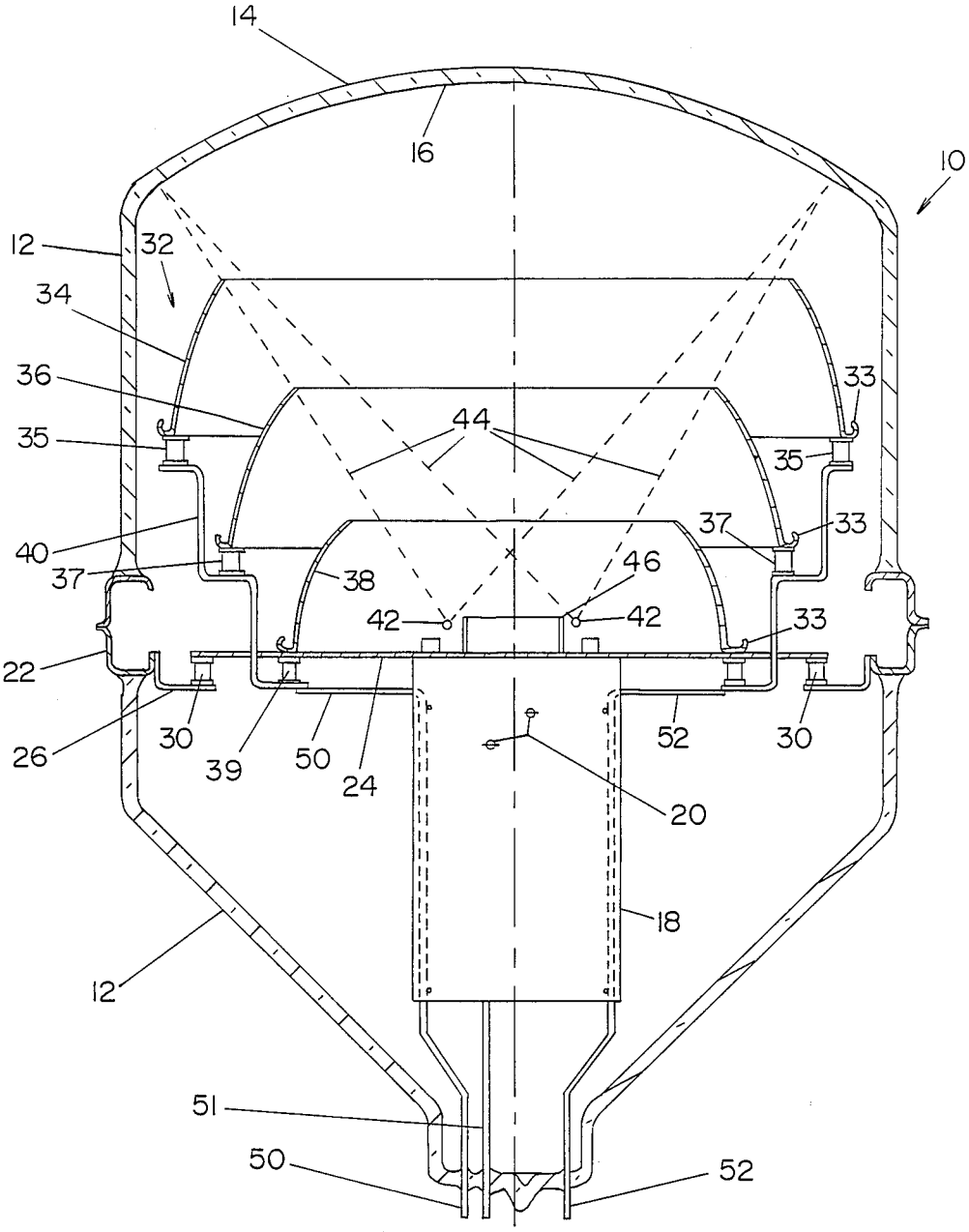
14
16
10
12
32
34
36
33
44
35
35
40
37
33
37
38
46
42
42
33
22
26
30
39
50
24
52
30
20
18
12
51
50
52

FOCUSING ELECTRODE STRUCTURE FOR PHOTOMULTIPLIER TUBES

SUMMARY OF THE INVENTION

This invention deals generally with electron discharge tubes and more specifically with a focusing electrode structure for a photomultiplier tube.

Photomultiplier tubes have become commonly used instruments for detecting low light levels. Typically they consist of a glass envelope with an electron emitting photocathode located on the inside surface of a faceplate on the envelope. When light strikes the photocathode, electrons emitted from it are directed toward and collected by an electron multiplier. The electron multiplier consists of several secondary emitting dynodes, the first of which receives the electrons from the photocathode. The electron multiplier has an electrical output which is directly related to the quantity of electrons collected by the first dynode.

In order to maximize the collection efficiency of a tube, that is, to increase the ratio of electrons collected by the first dynode relative to the number emitted for the photocathode, focusing electrodes are located between the photocathode and the first dynode. These electrodes are operated at various electrical potentials to create an electrical field between the photocathode and the first dynode. The ideal electrical field would direct and deliver all the emitted electrons to the first dynode.

However, there are other criteria for the electrical field, which is referred to as the electron optics of the tube because it focuses electrons as an optical system focuses light. One such criterion for evaluating photomultiplier tubes is electron transit time. Since all electrons do not leave the photocathode in a path exactly normal to the surface, some are, in effect, sent off at a somewhat sideways directed angle. In fact, the photocathode could easily be pictured to be similar to a lawn full of in-ground sprinkler heads, each spewing off electrons at all angles. Under such circumstances, even if the electron focusing is perfect, it still takes not only a finite minimum time for any one photocathode electron to reach the first dynode, but it also takes longer for an angularly emitted electron to reach the dynode than it does for an electron which was emitted normal to the surface. In effect, the angularly emitted electron must travel a longer path.

Therefore, another measurement of the electron optics of the tube is the "spread" of transit time. A large transit time spread prevents the tube from discriminating between individual light pulses which hit the photocathode within shorter times than the transit time spread, since the dynode receives the first electrons from a second pulse while it is still receiving the last electrons from a first pulse.

Another measure of the electron optics is the tightness of the trajectory of electrons delivered to the first dynode, in effect, the actual ability to focus the electrons. If the electrons are not focused into a narrow beam at the dynode, it is necessary to use a larger dynode area to increase collection efficiency. Unfortunately, due to geometric constraints a larger dynode area also increases the length of the multiplier section and results in a greater transit time spread because the electrons also have a transit time through the multiplier section.

The entire problem of maximizing collection efficiency while minimizing transit time spread is further aggravated when the photocathode increases in area. Prior to the present invention, it has been considered unavoidable that a larger photocathode face area would also increase transit time spread and decrease collection efficiency since the standard electron optics could simply not accommodate to the larger photocathode.

It is therefore clearly advantageous to have an electron focusing structure which more tightly focuses the electrons. Such a result means that the tube collection efficiency increases, the total transit time decreases, and even the size of the tube is reduced because a smaller multiplier section can be used.

The present invention attains all these goals.

The focusing electrode configuration of the present invention departs from the previous standard focusing structure for photomultiplier tubes, which was that of concentric cylinders, and instead uses coaxial focusing electrodes which are substantial sections of ellipsoidal domes.

In the preferred embodiment, substantial segments, that is, segments with surface angles of at least ten degrees, of spheroids with increasing radii and decreasing voltages are located sequentially from the multiplier section to the photocathode. These focusing electrodes create an electronic field which is more precise than any previously available. In the preferred embodiment with a nine inch diameter faceplate, it is not only possible to use the same multiplier assembly as previously used in a five inch diameter tube, but transit time spreads are achieved which are less than those of the smaller tube.

BRIEF DESCRIPTION OF THE DRAWING

The FIGURE is a simplified cross section view along the central axis of a photomultiplier tube which includes the preferred embodiment of the invention.

DETAILED DESCRIPTION OF THE INVENTION

The FIGURE is a simplified cross section view across the central axis of photomultiplier tube 10 showing the preferred embodiment in which glass envelope 12 is evacuated and includes faceplate 14 upon the inner surface of which photocathode 16 is formed.

It should be appreciated that photomultiplier tube is shown in simplified form for clarity of disclosure and only the portion of the structure necessary to describe the invention is shown in detail. In other respects photomultiplier tube 10 is constructed in conventional form as is well known and understood in the art.

Within tube 10 is electron multiplier assembly 18 in which are located first dynode 20, shown with phantom lines, and other dynodes (not shown) which operate in conventional manner to convert electrons impinging upon first dynode 20 into an electrical signal which is connected to external circuitry (not shown) by means of input or output leads of which lead 51 is typical.

Center support ring 22, attached to envelope 12, supports electron multiplier assembly 18 and support plate 24 by means of brackets 26 and insulators 30.

The preferred embodiment of the invention is focusing electrode assembly 32 comprising conductive first grid electrode 34, second grid electrode 36 and anode electrode 38.

As shown in the FIGURE, each electrode 34, 36 and 38 is a substantial section of a spheroid, an approximate sphere, with all being coaxial with the centerline of tube 10 and the two smaller electrodes extending into the larger opening of the larger adjacent electrode. Each electrode has a folded lip 33 on its edge most remote from photocathode 16.

Focusing electrode assembly 32 is located and supported by stepped brackets 40 which is itself supported from support plate 24 by insulators 39 and each electrode is connected to a voltage source (not shown) by means of input connectors such as 50 and 52 which penetrate envelope stem 54. Anode electrode 38 is attached to and supported from support plate 24, and stepped brackets 40 supports insulators 35 and 37 which, in turn, support electrodes 34 and 36 respectively.

As electrodes 34, 36 and 38 progress from the photocathode region to the multiplier region of tube 10, they become progressively smaller, each with a smaller spheroid radius and with smaller diameter openings at both ends than the openings in the preceding electrode. However, each electrode extends into a plane of the adjacent larger electrode so that together they form a complete shield.

This aspect of their positioning is particularly important for the focusing electrode structure's secondary function of shielding tube envelope 12 from evaporated antimony when photocathode 16 is formed by evaporating antimony from an evaporation means for example beads 42. As shown by antimony trajectory lines 44, the edges of electrodes 34 and 36 which are nearest photocathode 16 along with inner cylinder 46 act as shields to prevent antimony from covering any part of enevelope 12 other than faceplate 14.

The ellipsoid and spheroid shapes for focusing electrodes has been found to form electric fields which better focus the electrons moving from photocathode 16 to dynode 20. The unique curved shapes create smaller beam diameters at the dynode with longer depth of focus and they reduce the overall transit time and transit spread time compared to similarly sized cylindrical electrodes. The surface angle of the ellipsoid or spheroid is at least 10 degrees.

Moreover, the narrower openings near the photocathode furnish better antimony evaporation shields with shorter lengths than would a cylindrical electrode.

The preferred embodiment shown in the FIGURE, with a 9.0 inch diameter faceplate 16, has the approximate parameters noted in the following table with radii and diameters in inches:

| | Spheroid Radius | Smaller Opening Diameter | Larger Opening Diameter | Surface Angle, Degrees | Operating Potential |
|---|---|---|---|---|---|
| Grid 34 | 4.5 | 7.5 | 8.5 | 30 | 150 |
| Grid 36 | 3.5 | 5.5 | 7.0 | 35 | 500 V |
| Anode 38 | 3.0 | 4.5 | 6.0 | 40 | 2000 V |

The noted operating potentials were determined by well established methods of electric field design. The potentials and interelectrode spacing for various other electrode sizes can be described by these methods, which are well known in the art.

With the parameters shown in the table, the preferred embodiment of tube 10 has a total transit time spread of 1.8 nanoseconds. This compares to a figure of 2.4 nanoseconds for a conventional cylindrical shielded tube with only a 5 inch faceplate diameter.

Further advantages are derived from the domed electrode shape in that the structure provides superior structural strength with reduced material weight, so that the focusing electrodes are self supporting and resist distortion or damage from external shock and vibration.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, more or fewer ellipsoid shaped electrodes could be used in different size tubes, and they could be supported in a different manner than depicted.

We claim:

1. In a photomultiplier tube of the type including: an evacuated envelope; a faceplate extending across one end of the envelope with a photoemissive cathode located on the interior surface of the faceplate and the cathode providing photoelectrons when it is subjected to radiation; a stem sealing the other end of the envelope; a focusing electrode assembly acting upon the photoelectrons, supported from the envelope and located coaxial to the central axis of the photomultiplier tube; at least one evaporation means supported from the envelope and located for evaporating material onto the faceplate to form the photocathode; and an electron multiplier assembly supported from the envelope; the improvement wherein the focusing electrode assembly comprises:

at least one solid surface conductive electrode structure formed in the shape of a truncated section of an ellipsoid with its single smaller opening nearer the photocathode and its larger opening nearer the electron multiplier assembly and to which a focusing voltage is applied in order to create a focusing electric field.

2. The photomultiplier tube of claim 1 wherein the focusing electrode assembly comprises three electrode structures of different radii with the largest structure nearest to the photocathode and the smaller structure nearest to the electron multiplier assembly.

3. The photomultiplier tube of claim 2 wherein the smaller electrode structures are located so that their smaller opening is within a plane of an adjacent larger electrode structure.

4. The photomultiplier tube of claim 1 wherein the electrode structure is of a size so that its surface angle is at least 10 degrees.

5. In a photomultiplier tube of the type including: an evacuated envelope; a faceplate extending across one end of the envelope with a photoemissive cathode located on the interior surface of the faceplate and the cathode providing photoelectrons when it is subjected to radiation; a stem sealing the other end of the envelope; a focusing electrode assembly acting upon the photoelectrons, supported from the envelope and located coaxial to the central axis of the photomultiplier tube; at least one evaporation means supported from the envelope and located for evaporating material onto the faceplate to form the photocathode; and an electron multiplier assembly supported from the envelope; the improvement wherein the focusing electrode assembly comprises:

at least one solid surface conductive electrode structure formed in the shape of a truncated section of a spheroid with its single smaller opening nearer the photocathode and its larger opening nearer the electron multiplier assembly and to which a focusing voltage is applied in order to create a focusing electric field.

6. The photomultiplier tube of claim 5 wherein the focusing electrode assembly comprises three electrode structures of different radii with the largest structure nearest to the photocathode and the smaller structure nearest to the electron multiplier assembly.

7. The photomultiplier tube of claim 6 wherein the smaller electrode structures are located so that their smaller opening is within a plane of an adjacent larger electrode structure.

8. The photomultiplier tube of claim 5 wherein the electrode structure is of a size so that its surface angle is at least 10 degrees.

* * * * *